US005104326A

United States Patent [19]

Smith et al.

[11] Patent Number: 5,104,326

[45] Date of Patent: Apr. 14, 1992

[54] PRINTED CIRCUIT BOARD SHIELDED ELECTRICAL CONNECTOR

[75] Inventors: James Smith, York, Pa.; John E. Lopata, Naperville, Ill.

[73] Assignee: Molex Incorporated, Lisle, Ill.

[21] Appl. No.: 647,339

[22] Filed: Jan. 25, 1991

[51] Int. Cl.[5] ..... H01R 13/648; H01R 9/09

[52] U.S. Cl. ..... 439/95; 439/79; 439/607

[58] Field of Search ..... 439/79-83, 439/95, 607, 609

[56] References Cited

U.S. PATENT DOCUMENTS 4,869,677 9/1989 Johnson et al. ..... 439/80

4,938,704 7/1990 Fujiura ..... 439/95

*Primary Examiner*—Paula A. Bradley

*Attorney, Agent, or Firm*—Charles S. Cohen; Stephen Z. Weiss

[57] ABSTRACT

A right angle connector is adapted to be mounted on a printed circuit board and includes a connector housing having a front mating portion, a conductive shield having a shroud adapted to surround the front mating portion, and a tail aligner to support tail portions of terminals disposed in the connector housing. The shield is secured to the connector housing by latching tabs secured in apertures in the housing and includes a pair of ground straps with ground tabs projecting therefrom, each of the ground tabs has a curved end portion that is adapted to fit into holes in the printed circuit board on which the connector is to be mounted. The tail aligner has positioning and mounting tabs that latch into apertures in the connector housing so as to secure the tail aligner to the connector housing. In order to maintain the connector on the printed circuit board until after the ground tabs and the tail portions of the terminals are soldered to the printed circuit board, the tail aligner has two mounting tabs that are adapted to latch into mounting holes in the printed circuit board.

16 Claims, 3 Drawing Sheets

PRINTED CIRCUIT BOARD SHIELDED ELECTRICAL CONNECTOR

BACKGROUND OF THE INVENTION

1. Field of the Invention

The present invention relates to a shielded electrical connector that is adapted to be mounted on a printed circuit board, and more particularly, to a new and improved right angle shielded electrical connector with a shield having improved printed circuit board grounding tabs retained on its mating end and with a tail aligner supporting the tail portions of terminals in the electrical connector and having mounting tabs for maintaining the electrical connector on the printed circuit board until the tail portions of the terminals are soldered to the printed circuit board.

2. Description of the Prior Art

Right angle connectors are adapted to be mounted on a printed circuit board to interconnect the circuits on the printed circuit board to complementary connectors that mate with the right angle connector. Each of the terminals disposed in the right angle connector has a mating portion located in a mating end of the connector that extends generally parallel to the printed circuit board when the connector is mounted on the printed circuit board. Each of the terminals also has a tail portion that extends into the printed circuit board generally at a right angle to the plane of the printed circuit board. These tail portions extend from the connector into plated holes in the printed circuit board so that they may be soldered in the plated holes in order to couple circuits on the printed circuit board to the terminals in the electrical connector.

The tail portions of the terminals tend to be very thin and therefore fragile. As a result, it is advantageous to support the tail portions so that they will be properly aligned with the plated holes in the printed circuit board when the connector is mounted on the printed circuit board. In U.S. Pat. Nos. 4,744,771 and 4,857,017, components are disclosed that are used to support the tail portions of terminals that are to be inserted into a printed circuit board or the like. However, these components do not have any type of mounting tabs extending therefrom for maintaining the connector on the printed circuit board until the terminals are soldered to the printed circuit board.

In certain applications, the front or mating end of the electrical connector also is provided with a shield. Shields for mounting about a front or mating end of a connector housing are disclosed in U.S. Pat. Nos. 4,718,866; 4,789,357 and 4,838,811. Any such shield must not only be secured about the front or mating end of the electrical connector housing, but also must be connected to the printed circuit board on which the electrical connector is to be mounted. U.S. Pat. Nos. 4,721,473; 4,842,528; 4,842,529; 4,842,552; and 4,850,885 as well as PCT application No. WO 89/08339 and German Patent No. DE 37 38 545 A1 illustrate various types of grounding mechanisms utilized in coupling a shield of an electrical connector to a printed circuit board. While these patents and applications do disclose shields that may be mounted about the front mating end of an electrical connector, the shields do not have integral grounding tabs that have an improved configuration to assure that the grounding tabs are properly soldered to ground circuits on the printed circuit board.

SUMMARY OF THE INVENTION

Accordingly, one object of the present invention is to provide a new and improved right angle electrical connector that is adapted to be mounted on a printed circuit board.

It is another object of the present invention to provide a new and improved printed circuit board mounted electrical connector having a tail aligner that not only provides support for the tail portions of terminals to be soldered to the printed circuit board, but also provides mounting tabs for maintaining the electrical connector on the printed circuit board until the tail portions of the terminals are actually soldered to the printed circuit board.

It is yet another object of the present invention to provide a new and improved electrical connector having a shield that is secured about a front, mating end of the electrical connector and that has grounding tabs with curved end portions that enable the shield to be properly coupled to ground circuits on the printed circuit board.

In accordance with these and many other objects, an embodiment of the present invention comprises a right angle connector that is adapted to be mounted on a printed circuit board. The connector includes a connector housing having a front mating portion projecting from a front face of the connector housing, a front conductive shield having a shroud adapted to surround the front mating portion, and a tail aligner to support tail portions of terminals disposed in the connector housing and to maintain the connector on the printed circuit board until the tail portions of those terminals are soldered to the printed circuit board.

The connector housing is made of a dielectric material and includes a plurality of right angle terminals. The contact portions of the terminals are positioned in terminal cavities that extend into the front mating portion of the connector housing. An intermediate portion of each of the terminals interconnect the contact portions to the tail portions that project from the bottom of the connector housing so that they can be inserted into holes in the printed circuit board on which the connector is to be mounted. The terminals are preloaded into the terminal cavities in pairs so the contact portions of each pair of terminals are adapted to receive therebetween a contact of a mating connector.

The shield has a plurality of tabs that are adapted to be latched in corresponding apertures in the connector housing in order to secure the shield on the connector housing. When the shield is so secured to the housing, a front mating portion of the shield shrouds or surrounds the front mating portion of the connector housing. In addition, a pair of ground straps extending perpendicularly from edges of the front face of the shield are positioned in recesses in a bottom surface of the connector housing. A ground tab extends perpendicularly from each of the ground straps. Each of these ground tabs has a curved end portion that is adapted to fit into holes in the printed circuit board on which the connector is to be mounted such that the ground tabs can be properly and adequately soldered to ground circuits contained on the printed circuit board.

The tail aligner fits over the bottom mounting surface of the connector housing and includes positioning and mounting tabs that latch into apertures in the connector housing so as to secure the tail aligner to the connector housing. In order to accommodate the ground tabs, the tail aligner has a pair of curved apertures through which the ground tabs extend. In addition, the tail aligner has an array of holes through which the tail portions of each of the terminals disposed in the connector housing extend such that the terminals will be supported until they are installed on the printed circuit board and soldered thereto. In order to maintain the connector on the printed circuit board until after the ground tabs and the tail portions of the terminals are soldered to the printed circuit board, the tail aligner has two mounting tabs that extend from its bottom surface and that are adapted to latch into mounting holes in the printed circuit board.

BRIEF DESCRIPTION OF THE DRAWINGS

Many other objects and advantages of the present invention will become apparent upon consideration of the following detailed description in conjunction with the drawings in which.

DETAILED DESCRIPTION OF THE PREFERRED EMBODIMENT

Figure 1:
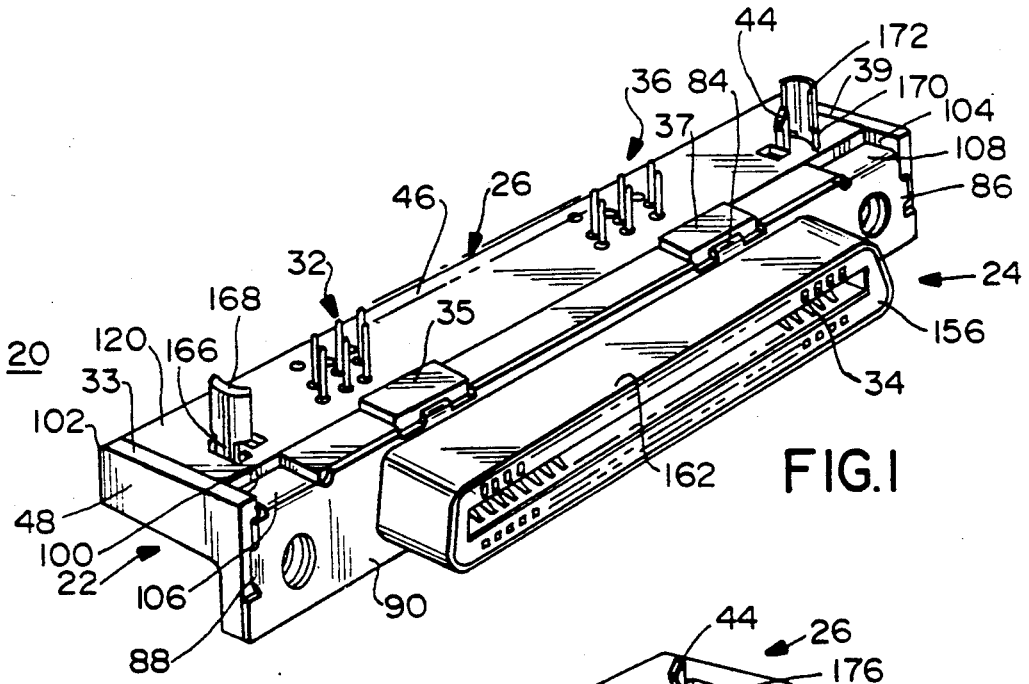
FIG. 1 is a perspective view of the electrical connector embodying the present invention in which only some of the terminals normally contained in the electrical connector are disclosed.
Figure 2:
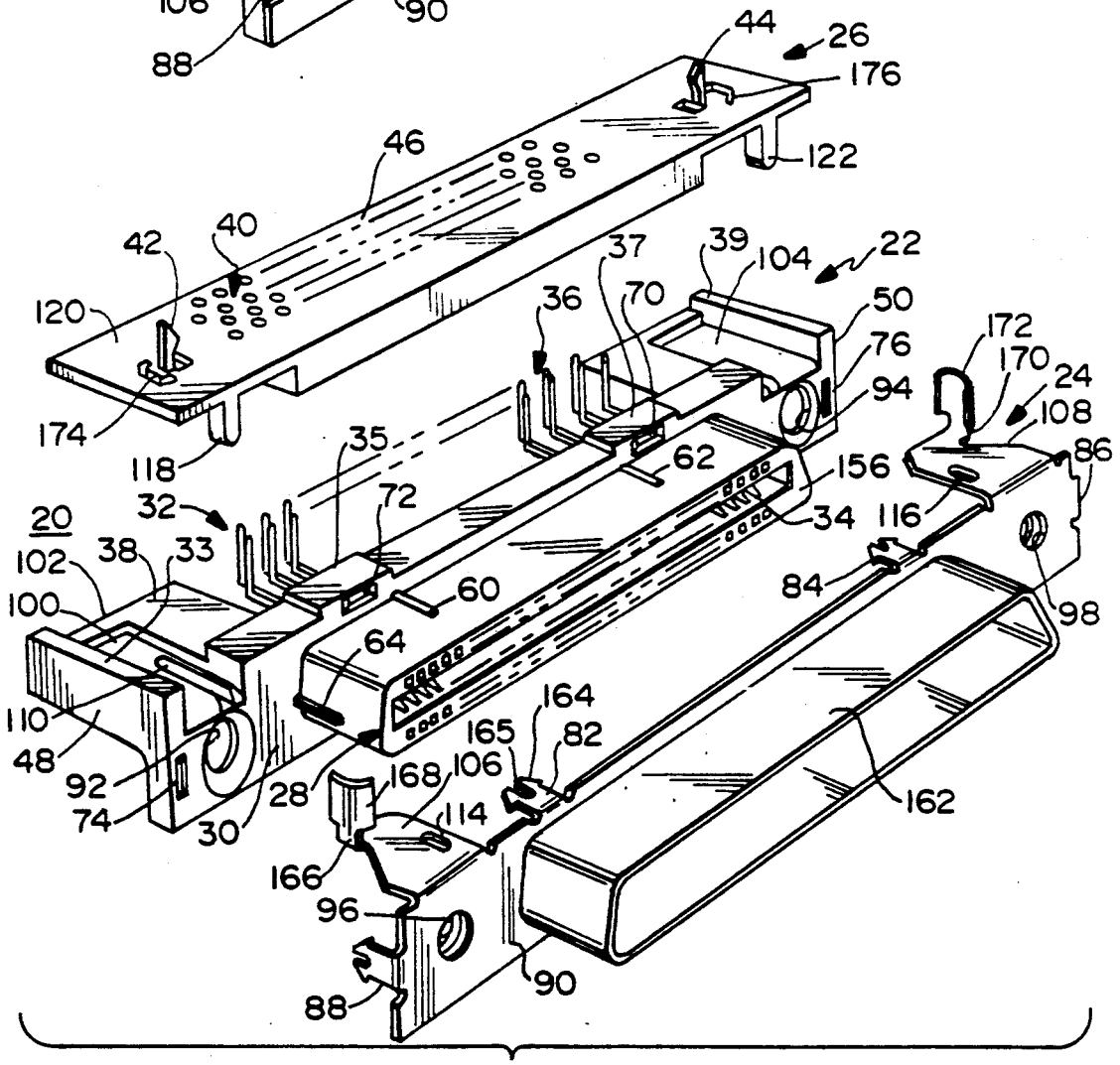
FIG. 2 is a perspective, partially exploded view similar to FIG. 1 with the shield and tail aligner separated from the housing of the electrical connector of FIG. 1.
Figure 4:
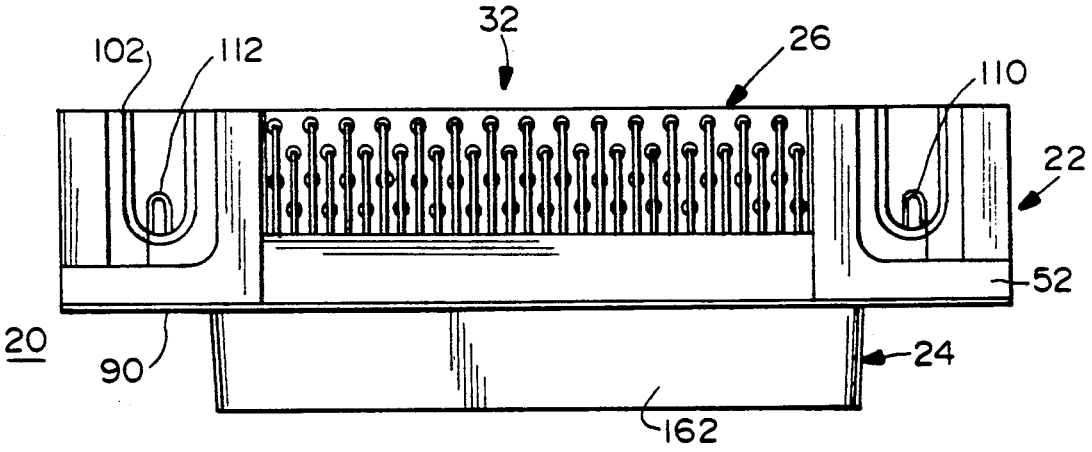
FIG. 4 is a top view of the electrical connector shown in FIG. 3.

Referring now more specifically to FIGS. 1–2 of the drawings, therein is disclosed an electrical connector which is adapted to be mounted on a printed circuit board (not shown), which is generally designated by the numeral 20 and which embodies the present invention. The electrical connector 20 includes an electrical connector housing 22, a front conductive shroud or shield 24 and a tail aligner 26. The connector housing 22 has a front mating portion 28 projecting outwardly from a front face 30. A plurality of right angle terminals 32 are disposed in the housing 22. The terminals 32 have female mating end portions 34 disposed in the front mating portion 28 and tail portions 36 projecting from a bottom face 38 of the connector housing 22. The tail portions 36 of the terminals 32 are adapted to be inserted in holes in the printed circuit board on which the electrical connector 20 is to be mounted such that the bottom face 38 of the connector housing 22 will be positioned adjacent the printed circuit board with the front mating face 30 disposed at a generally right angle with respect to the plane of the printed circuit board. Board standoffs 33, 35, 37 and 39 extend away from bottom face 38 toward the printed circuit board (not shown) to locate connector 20 above the board.

The shield or shroud 24 is adapted to be positioned about the mating portion 28 and over the front face 30 when the shield 24 is affixed to the connector housing 22. On the other hand, the tail aligner 26 is adapted to be mounted along the bottom face 38 of the connector housing 22. When so mounted, the tail portions 36 of the terminals 32 will extend through an array of holes 40 in the tail aligner 26 so that the tail portions 36 are supported by the tail aligner 26 until inserted into and soldered in holes in the printed circuit board. The tail aligner 26 also includes mounting tabs 42 and 44 that extend outwardly from a bottom surface 46 of the tail aligner 26. The mounting tabs 42 and 44 are adapted to fit into holes on the printed circuit board in order to maintain the electrical connector 20 positioned on the printed circuit board until after the tail portions 36 have been soldered to the printed circuit board.

The connector housing 22 is made of a dielectric material. As best seen in FIGS. 1–2 and 6–8 of the drawings, the connector housing 22 includes the front mating portion 28 projecting outwardly from the front face 30. The front face 30 of the connector housing 22 extends between side edges 48 and 50 and between the bottom face 38 and a top wall 52. The front mating portion 28 is generally trapezoidal in shape with rounded side edges and is adapted to receive a male type header or the like (not shown) that will be disposed in the mating end portions 34 of the terminals 32. As will be discussed hereinafter, a series of stand-off ribs 54, 56, 58, 60, 62 and 64 project from the outer periphery of the front mating portion 24 and aid in mounting the shield 24 about the front mating portion 28.

A pair of tab receiving apertures 66 and 68 extend through the front face 30 adjacent the top wall 52 of the connector housing 22. Similar tab receiving apertures 70 and 72 are disposed through the front face 30 of the connector housing 22 adjacent the bottom end 38 of the connector housing 22 and another pair of apertures 74 and 76 extend through the front mating face 30 of the connector housing 22 adjacent the side edges 48 and 50, respectively. The apertures 66, 68, 70, 72, 74 and 76 are adapted to receive respectively tabs 78, 80, 82, 84, 86 and 88 that extend rearwardly from a front mating face 90 of the shield 24 when the shield 24 is mounted on the connector housing 22 (see FIGS. 1–3 of the drawings).

The connector housing 22 also includes holes 92 and 94 that extend through the front mating face 30 adjacent respectively the side edges 48 and 50. These holes 92 and 94 will be in alignment with threaded, extruded holes 96 and 98 in the front face 90 of the shield 24 when the shield 24 is mounted on the connector housing 22. The aligned holes threaded and extruded holes 92 and 96 and the aligned holes 94 and 98 are adapted to receive fasteners therethrough so that another connector may be secured in mating relationship with the connector 20.

A recess 100 is located in the connector housing 22 adjacent the side edge 48 and the bottom end 38 and extends from the front mating face 30 toward a rear edge 102 of the connector housing 22. A similar recess 104 is disposed adjacent the side edge 50 and bottom face 38 and extends from the front mating end 30 toward the rear edge 102 of the connector housing 22. The recesses 100 and 104 are adapted to receive ground straps 106 and 108, respectively, that extend perpendicularly from the front mating face 90 of the shield 24.

An aperture 110 extends from the recess 100 through the connector housing 22 toward the top edge 52. A similar aperture 112 extends from the recess 104 through the connector housing 22 toward the top edge 52. An oval-shaped aperture 114 in the ground strap 106 will be positioned in alignment with the aperture 110 when the shield 24 is positioned on the connector housing 22. Similarly, an oval-shaped aperture 116 in the ground strap 108 will be positioned in alignment with the aperture 112 when the shield 24 is mounted on the connector housing 22. A positioning and holding tab 118 extending from a top surface 120 of the tail aligner 26 is adapted to extend through the aligned apertures 110 and 114. Likewise, a positioning and holding tab 122 extending from the top surface 120 of the tail aligner 26 is adapted to extend through the aligned apertures 112 and 116.

As previously indicated, the connector housing 22 includes a plurality of right angle terminals 32. As is the case with respect to the terminals 124 and 126 illustrated in FIG. 5 of the drawings, the terminals 32 are mounted in pairs along the length of the connector housing 22 extending between the side edges 48 and 50.

In the case of the terminal 124, the terminal 124 includes a mating portion 128, an intermediate or connecting portion 130 and a tail portion 132. The tail portion 132 is adapted to extend through the tail aligner 26 into a plated hole in the printed circuit board on which the connector 20 is to be mounted so that it can be soldered to circuits on the printed circuit board. The intermediate portion 130 interconnects the tail portion 132 to the mating portion 128 and has a right angle configuration so that the mating portion 128 extends generally at a right angle with respect to the tail portion 132. The mating portion 128 includes a hooked end portion 134 and a curved contact portion 136. The mating portion 128 extends at an angle from the intermediate portion 130 so that the contact portion 136 forms a spring contact.

Figure 5:
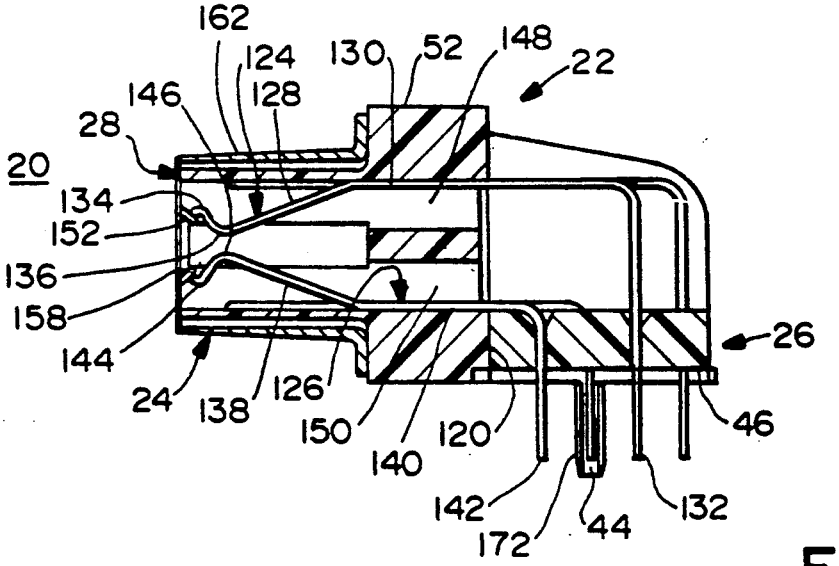
FIG. 5 is a cross-sectional view of the electrical connector of FIG. 3 taken along line 5—5 in FIG. 3.
Figure 8:
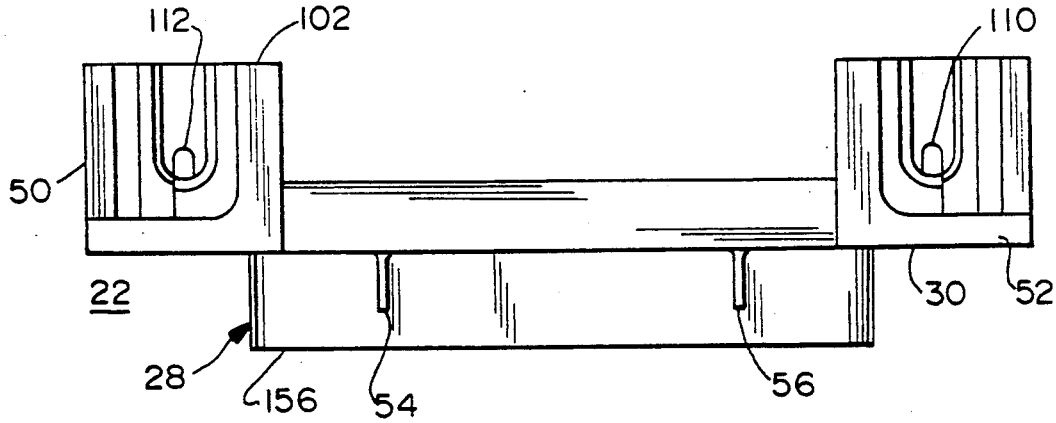
FIG. 8 is a top view of the electrical connector housing shown in FIG. 6.
Figure 6:
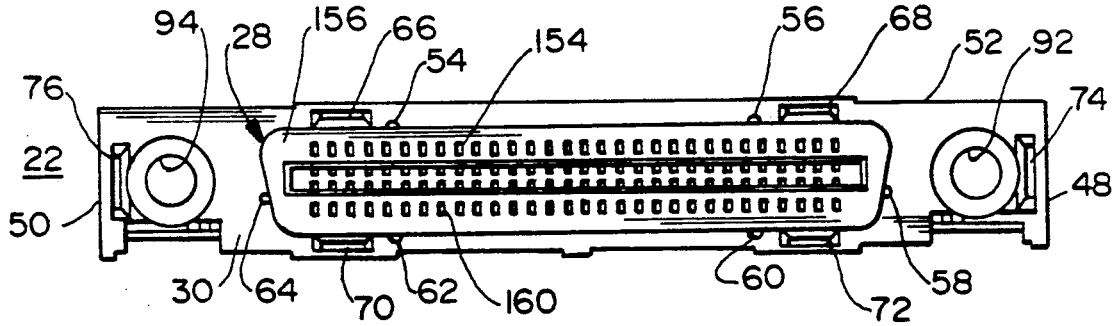
FIG. 6 is a front view of the housing of the electrical connector shown in FIG. 1 without any terminals being disposed therein.
Figure 7:
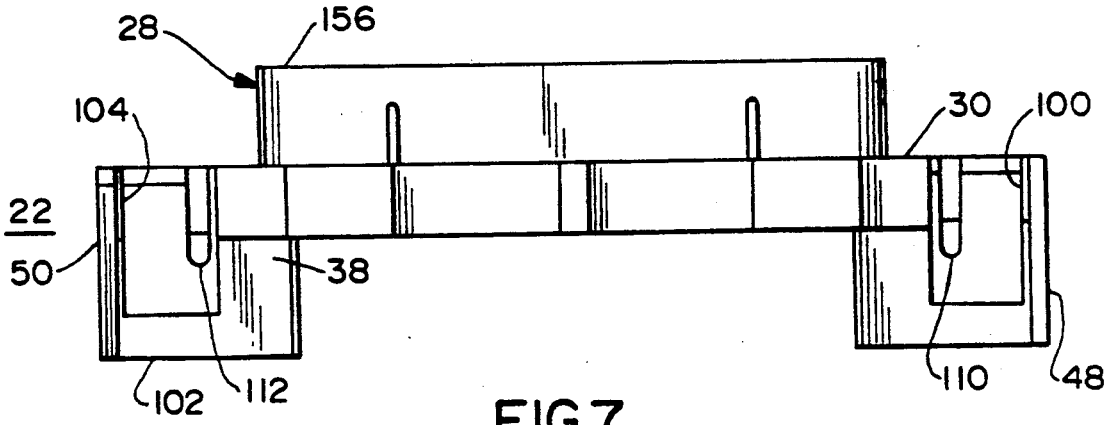
FIG. 7 is a bottom view of the electrical connector housing shown in FIG. 6.

The terminal 126 similarly includes a mating portion 138, an intermediate or connecting portion 140 and a tail portion 142. The tail portion 142 is adapted to extend through the tail aligner 26 into a plated hole in the printed circuit board on which the connector 20 is to be mounted so that it can be soldered to circuits on the printed circuit board. As seen in FIG. 5, the tail portion 142 is in alignment with the tail portion 132 of the terminal 124 but is positioned in front of the tail portion 132 (i.e., toward the front face 30 of the connector housing 22). The intermediate portion 140 interconnects the tail portion 142 to the mating portion 138 and has a right angle configuration so that the mating portion 138 extends generally at a right angle with respect to the tail portion 142. The mating portion 138 includes a hooked end portion 144 and a curved contact portion 146. The mating portion 138 extends at an angle from the intermediate portion 140 so that the contact portion 146 forms a spring contact.

Figure 3:
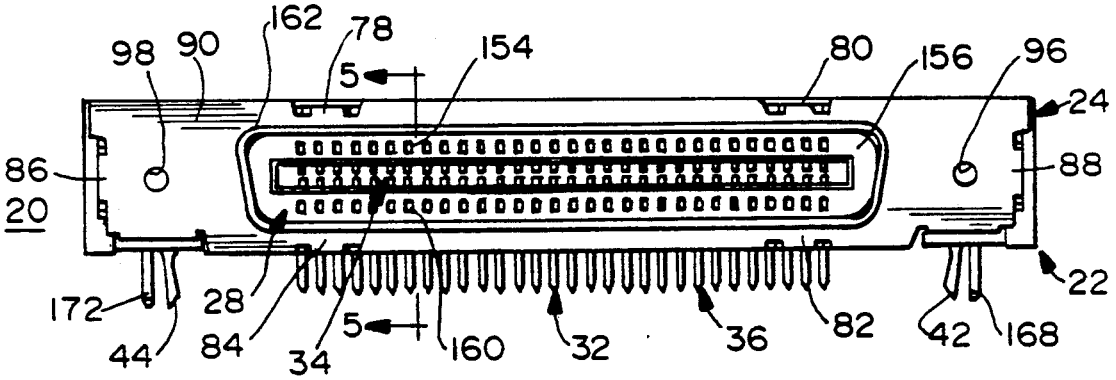
FIG. 3 is a front view of the electrical connector shown in FIG. 1.

As can be seen in FIGS. 3 and 5, the terminal 124 is mounted in an upper terminal cavity 148 which extends from the rear edge 102 of the connector housing 22 into the front mating portion 28. The terminal 126 similarly is mounted in a lower terminal cavity 150 which is located just below the upper terminal cavity 148 and which extends from the rear edge 102 of the connector housing 22 into the front mating portion 28. In the case of the terminal 124, it is loaded into the terminal cavity 148 by sliding the mating portion 128 of the terminal 124 into the cavity 148 from the open rear end 102 of the connector housing 22. Due to the fact that the walls of the connector housing 22 forming the terminal cavity 148 must be thin in cross section, the intermediate portion 130 is designed to conform to the side walls of the terminal cavity 148 to insure proper positioning of the terminal 124 in the terminal cavity 148. When the terminal 124 is inserted into the terminal cavity 148, the hooked end 134 becomes hooked on an inclined wall 152 in a cavity 154 that projects through a front face 156 of the mating portion 28. When the terminal 124 is so disposed in the cavity 148, the terminal 124 is spring loaded in the cavity 148 so that the contact portion 136 is disposed as disclosed in FIG. 5 of the drawings.

The terminal 126 similarly is disposed in the terminal cavity 150 such that the hooked end portion 144 becomes engaged with an inclined wall 158 in a cavity 160 projecting through the front face 156 of the mating portion 28. As a result, the terminal 126 is spring loaded in the cavity 150 such that the contact portion 146 is disposed adjacent to the contact portion 136 of the terminal 124. With the contact portions 136 and 146 so positioned, the contact portions 136 and 146 form opposed contacts that are adapted to receive therebetween contacts of a connector that is mated with the connector 20 and the preloading of the contact portions 136 and 146 enables the terminals 124 and 126 to be biased against the contacts inserted between the contact portions 136 and 146 without applying a significant normal force against a printed circuit board on which the connector 20 is to be mounted.

The shield 24 is made of a conductive material such as an aluminum killed steel and includes the front mating face 90 from which projects a shield mating portion 162. The shield mating portion 162 has a general trapezoidal shape corresponding to the shape of the mating portion 28 of the connector housing 22. Consequently, the shield 24 may be slid into position on the connector housing 22 such that the shield mating portion 162 is disposed about the mating portion 28 as it slides on the stand-off ribs 54, 56, 58, 60, 62 and 64. As the shield 24 is slid into position about the mating portion 28, the tabs 78, 80, 82, 84, 86 and 88 become disposed in the corresponding apertures 66, 68, 70, 72, 74 and 76. In the case of the tab 82 in FIG. 2 of the drawings, the tab 82 has an enlarged end portion 164 and a slot 165 that is elastically deformed during insertion into aperture 72. The other tabs 78, 80, 84, 88 and 86 are formed and secured in like manner in the corresponding apertures 66, 68, 70, 74 and 76.

When the shield 24 is secured in position on the connector housing 22, the front face 90 covers the front face 30 of the connector housing 22 (see for example, FIGS. 1 and 3), the hole 96 is in alignment with the hole 92 and the hole 98 is in alignment with the hole 94. In addition, the ground straps 106 and 108 will be disposed in the recesses 100 and 104, respectively, and the oval-shaped apertures 114 and 116 are respectively in alignment with the apertures 110 and 112. The ground strap 106 has an upstanding leg or ground tab 166 with a curved end portion 168. A similar upstanding leg or ground tab 170 projects from the ground strap 108. The leg 170 has a curved end portion 172. As will be discussed hereinafter, the curved end portions 168 and 172 are adapted to be disposed in holes in the printed circuit board on which the connector 20 is to be mounted so that the end portions 168 and 172 may be soldered to ground circuits on the printed circuit board.

After the shield 24 is secured in position on the connector housing 22, the tail aligner 26 also may be positioned on the connector housing 22. As seen in FIG. 2, the tail aligner 26 has the array of holes 40 that has the same pattern as the pattern formed by the tail portions 36 of the terminals 32. As a result, the tail aligner 26 can be slid over the tail portions 36 of the terminals 32. The tail aligner 26 also has curved openings 174 and 176 adjacent respectively the mounting tabs 42 and 44. As the tail aligner 26 is slid over the tail portions 36 of the terminals 32, the openings 174 and 176 will slide over the curved end portions 168 and 172 projecting from the ground straps 106 and 108 such that the curved end portions 168 and 172 will extend out from the bottom surface 46 of the tail aligner 26 (see for example FIG. 1). In addition, the positioning and holding tabs 118 and 122 extending from the top surface 120 of the tail aligner 26 will extend through the oval-shaped apertures 114 and 116 in the ground straps 106 and 108, respectively, and extend through the apertures 110 and 112. The tabs 118 and 122 are heat staked to deform the ends of the tabs in order to hold the assembly together. That is, tail aligner 26 is held in position on the connector housing 22 which in turn aids in securing the ground straps 106 and 108 in the corresponding recesses 100 and 104 along the bottom end 38 of the connector housing 22 because the positioning and holding tabs 118 and 122 extend through the oval-shaped apertures 114 and 116.

As can be seen in FIGS. 1 and 5, with the tail portions 36 of the terminals 32 positioned in the holes 40 in the tail aligner 26, the tail aligner 26 supports the tail portions 36 in proper spatial relationship to each other so that the tail portions 36 are maintained in proper alignment with holes in the printed circuit board on which the connector 20 is to be mounted as the connector 20 is mounted on that printed circuit board. It is advantageous to provide a tail aligner, such as the tail aligner 26, to support the tail portions 36 because the terminals 32 tend to be thin and therefore fragile. The tail aligner 26 serves the additional function of securing the connector 20 to the printed circuit board on which the connector 20 is to be mounted until after the tail portions 36 are soldered to the printed circuit board. In this regard, the mounting tabs 42 and 44 become lodged in mounting holes on the printed circuit board and latch the tail aligner 26 and thereby the connector 20 to the printed circuit board until the tail portions 36 of the terminals 32 are soldered to the printed circuit board. It is necessary to provide such mounting tabs 42 and 44 to secure the connector 20 to the printed circuit board because the tail portions 36 are smaller in diameter than the holes into which they are inserted and the radius of curvature of the curved end portions 168 and 172 of the ground tabs 166 and 170 that project respectively from the ground straps 106 and 108 also are smaller than the radius of the holes in the printed circuit board into which they are inserted. Consequently, neither the tail portions 36 nor the end portions 168 and 172 provide any retention function prior to the soldering of the tail portions 36 and the end portions 168 and 172 to the printed circuit board.

As noted above, the grounding end portions 168 and 172 are adapted to be installed into plated ground holes on the printed circuit board. The curved shaped of the end portions 168 and 172 provides a greater surface area to increase the conductivity from the shell to the printed circuit board and to affect the soldering of the end portions 168 and 172 to the round holes of the printed circuit board into which the end portions 168 and 172 are inserted. As a result, the shield 24 is provided with integral ground straps 106 and 108 that are directly coupled via the ground tabs 166 and 170 to the printed circuit board but the curved end portions 168 and 172 of the ground tabs 166 and 170 respectively enable the grounding straps 106 and 108 and therefore the shield 24 is properly coupled to ground circuits on the printed circuit board.

Obviously, many modifications and variations of the present invention are possible in light of the above teachings. Thus, it is to be understood that, within the scope of the appended claims, the invention may be practiced otherwise than as specifically described above.

What is claimed is:

1. An electrical connector adapted to be mounted on a printed circuit board comprising:

a dielectric connector housing, a plurality of terminals disposed in said connector housing, each of said terminals having a tail portion adapted to be inserted into said printed circuit board; and a tail aligner means mounted on aid connector housing and supporting said tail portions for mounting said tail aligner means having mounting means for mounting said tail aligner means and thereby said connector too said printed circuit board, said mounting means including a pair of mounting tabs integrally formed with and projecting from said tail aligner means, each of said mounting tabs being adapted to latch into holes in said printed circuit board in order to retain said tail aligner means on said printed circuit board.

2. The electrical connector as set forth in claim 1 wherein said tail aligner means includes positioning and holding means to secure said tail aligner means to said connector housing and includes a first surface from which said mounting tabs project and an opposite second surface from which said position in and holding means project.

3. The electrical connector as set forth in claim 1 wherein said tail aligner means includes positioning and holding means to secure said tail aligner means to said connector housing.

4. The electrical connector as set forth in claim 1 wherein said tail aligner means includes an array of holes through which said tail portions of said terminals project when said tail aligner means is secured to said connector housing.

5. An electrical connector adapted to be mounted on a printed circuit board comprising:

a connector housing having a front mating portion;

a plurality of terminals disposed in said housing, each of said terminals having a mating portion disposed in said front mating portion; and p1 a conductive shield means mounted about said mating portion of said connector housings aid shield means having at least one ground tab integrally formed therewith and projection therefrom with a curved end portion that is adapted to be inserted into a ground hole i said printed circuit board, said curved end portion having an outer curved surface dimensioned such that substantially the entire outer curved surface is located in proximity to a portion of the periphery of the ground hole when said end portion is inserted into the ground hole to facilitate mechanical and electrical interconnection of the curved end portion to said ground hole along substantially the entire outer curved surface of said end portion.

6. The electrical connector as set forth in claim 5 wherein said shield means includes mounting tabs that are adapted to be latched into apertures in said connector housing to retain said shield means about said mating portion of said connector housing.

7. The electrical connector as set forth in claim 5 wherein said front mating portion of said connector housing includes a plurality of rib means to aid in mounting said shield means on said front mating portion.

8. The electrical connector as set forth in claim 5 wherein said connector housing includes a housing front face from which said front mating portion projects and said shield means includes a shield front face that covers said housing front face when said shield is secured to said connector housing, said shield means further including at least one ground strap which projects from said shield front face and which is adapted to be disposed in a recess inn said connector housing.

9. The electrical connector as set forth in claim 8 wherein said ground tab projects from said ground strap and wherein the radius of curvature of said end portion is less than the radius of said ground hole.

10. The electrical connector as set forth in claim 8 wherein said electrical connector includes two ground tabs, each of which ground tabs including curved end portions that are adapted to be inserted into ground holes in said printed circuit board.

11. An electrical connector for mounting on a printed circuit board comprising:

a connector housing having a front mating portion, a plurality of terminals disposed in said housing, each of said terminals having a mating portion disposed in said front mating portion and a tail portion adapted to be inserted into said printed circuit board;

a tail aligner means mounted on said connector housing and supporting said tail portions of said terminals, said tail aligner means having mounting means for mounting said tail aligner means and thereby said connector to said printed circuit board; and a conductive shield means mounted about said front mating portion of said connector housing, said shield means having at least one ground tab integrally formed therewith and projecting therefrom with a curved end portion that is adapted to be inserted into a ground hole in said printed circuit board.

12. The electrical connector as set forth in claim 11 wherein said terminals are disposed in terminal cavities in said connector housing in pairs so that said mating portions of each said pair of terminals forms a spring contact therebetween.

13. The electrical connector of claim 11 wherein said mounting means comprises an integrally formed latch mechanism that secures said connector to said ground hole prior to soldering said connector to said printed circuit board.

14. The electrical connector as set forth in claim 11 wherein said shield means includes at least one ground strap that is adapted to be disposed in a recess in said connector housing.

15. The electrical connector as set forth in claim 14 wherein said ground strap has a ground aperture that is in alignment with a mounting aperture in said recess in said connector housing when said ground strap is positioned in said recess.

16. The electrical connector as set forth in claim 15 wherein said tail aligner means includes positioning and holding means to secure said tail aligner means to said connector housing, said positioning and holding means extending through said ground aperture and into said mounting aperture to thereby secured said tail aligner means to said connector housing and to aid in securing said shield means to said connector housing.

* * * * *

UNITED STATES PATENT AND TRADEMARK OFFICE

CERTIFICATE OF CORRECTION

PATENT NO. : 5,104,326

DATED : April 14, 1992

INVENTOR(S) : James Smith, York, et al.

It is certified that error appears in the above—identified patent and that said Letters Patent is hereby corrected as shown below:

Column 8:

Claim No. 1, line 12, delete the word "too" and inser the word --to--.

Claim No. 5, line 6, delete "pl"; line 8, delete "aid" and insert --, said--; line 12, delete "i" and insert --in--.

Signed and Sealed this

Seventeenth Day of August, 1993

Bruce Lehman

*Attest:*

BRUCE LEHMAN

*Attesting Officer*

*Commissioner of Patents and Trademarks*